US006491086B2

(12) United States Patent
Bettio et al.

(10) Patent No.: US 6,491,086 B2
(45) Date of Patent: Dec. 10, 2002

(54) MECHANISM FOR THE QUICK HOOKING AND UNHOOKING OF A HANDLE, USED PARTICULARLY FOR FLY SCREENS AND FLY SCREEN ASSEMBLIES

(75) Inventors: Denis Bettio, Marcon (IT); Loris Bettio, Marcon (IT)

(73) Assignee: Bettio Group SRL, Marcon (IT)

( * ) Notice: Subject to any disclaimer, the term of this patent is extended or adjusted under 35 U.S.C. 154(b) by 0 days.

(21) Appl. No.: 09/802,683

(22) Filed: Mar. 9, 2001

(65) Prior Publication Data

US 2002/0124974 A1 Sep. 12, 2002

(51) Int. Cl.[7] ..... E06B 9/56
(52) U.S. Cl. ..... 160/290.1; 160/276; 292/DIG. 4
(58) Field of Search ..... 160/290.1, 321, 160/310, 276, 280, 281; 292/DIG. 4

(56) References Cited

U.S. PATENT DOCUMENTS 1,885,756 A * 11/1932 Norquist et al.
6,056,333 A * 5/2000 Wach
6,186,214 B1 * 2/2001 Ladd et al.
6,296,040 B1 * 10/2001 Schaap

* cited by examiner

*Primary Examiner*—Blair M. Johnson
(74) *Attorney, Agent, or Firm*—Harrison & Egbert

(57) ABSTRACT

A mechanism for quick hooking and unhooking of a handle, used particularly for fly screens and fly screen assemblies with a chain-operated movement. The invention includes a casing containing a rewind roll, a screen fastened to the rewind roll and a handle, and runners. The handle was a tubular profile with a hooking mechanism on one end. The hooking mechanism of the handle operates in conjunction with a reciprocal holder attached to a lower end of a runner.

11 Claims, 2 Drawing Sheets

MECHANISM FOR THE QUICK HOOKING AND UNHOOKING OF A HANDLE, USED PARTICULARLY FOR FLY SCREENS AND FLY SCREEN ASSEMBLIES

BACKGROUND OF THE INVENTION

1. Field of the Invention

The aim of this invention is a mechanism for the quick hooking and unhooking of a handle, used particularly for fly screens and fly screen assemblies made with this system.

The invention has particular, but not necessarily exclusive, application in the fixture accessories sector, such as fly screens, roller blinds and sun blinds.

2. Description of Related Art

Fly screens are divided into two categories. The first type is made to measure, manufactured according to the dimensions required for a given client, delivered to the said client and installed by a specialized installation technician. The other type is sold in kit form, and is the type that is most widely available on the market.

The latter type of fly screen is reasonably efficient and economic and is the type at which this invention is mainly aimed. Large quantities of components have to be fabricated and transported by the manufacturing companies, especially when dealing with overseas markets. The "do-it-yourself" concept is widely used and offers a product that satisfies most normal requirements, although it is not up to the standards of the made-to-measure type.

Both of the examples mentioned have certain components in common, such as the casing, which is generally made from extruded aluminum bar. It is used to contain the rewind mechanism for the fly screen, roller blind or sun blind, and the manual version has a corresponding loaded return spring. The ends of the casing are sealed by special plates or headers, which are supplied in two different versions, a fixed type or together with counter-plates or caps that can be regulated.

There are obviously a number of variations, although they are very similar to the systems described, and are just as common in fly screens as in roller blinds and sun blinds. One of these variations is a lower quality fly screen without the aforementioned return spring inside its mechanism. They differ from the first type in that they are manually operated both for unwinding and rewinding the fly screen. In this case, there is a closed-loop chain that hooks around a cog fixed on the relative rewind roll contained inside a casing for unwinding and rewinding the fly screen, roller blind or sun blind in a controlled manner.

These solutions foresee the fabrication of structures, for example fly screens, which are made up as follows:

- a casing that is closed at the ends by corresponding headers;
- a rewind roll contained inside the said casing, supported at both ends, that is fixed to the ends of the casing;
- a helicoidal torsion spring positioned co-axially, that works in conjunction with the said rewind roll;
- a rod positioned co-axially to the said helicoidal spring;
- a piece of material or cloth, either net type or for shading purposes, joined at one end to the rewind roll, and at the other end to a handle;
- and, two runners in which the two ends of the said handle and the edges of the said material or cloth slide.

Especially with the type that has the rewind roll controlled by the closed-loop chain mechanism, certain drawbacks have been encountered. They are due to the fact that the material or cloth is only held tight by the handle which is weighted. As a result, this type of structure has no means that acts upon the handle to counteract pressure exerted on the surface of the material or cloth. In fact, if the material or cloth is subjected to pressure on the surface, due to winds or a part of the body accidentally pushing against it, it is deformed according to the amount of pressure exerted, with the handle that is lifted proportionally to the said deformation of the material or cloth. This deformation, which is usually unstable, produces a phenomenon that is known as "sail effect" and which is the main cause of the aforementioned drawbacks.

Firstly, the efficiency of the material or cloth may be compromised because, especially with the cheaper fly screens, the lateral edges tend to come out of the runners to leave openings through which insects or light may pass.

Secondly, because of the continuous effect of the wind which blows in various directions, the fly screen may be noisy, an effect that is increased by the sudden rubbing of the metallic components, due to the back and forth movement or the lateral play of the handle inside its relative runners.

To overcome these and other drawbacks, some consumers choose fly screens with two battens that slide horizontally rather than vertically. In this case, the material or cloth is wound by pulling the handle in one direction, and fixing it in position when it reaches its limit with vertically mobile fasteners, the ends of which go inside corresponding seats, usually positioned on the vertical runner. Since this type of fly screen has two battens, both purchase price and installation costs are higher. This is because two casings are usually required, each one positioned along the two sides in order to fit out the two spaces. A large part of the cost, according to the individual supplier, depends on the type of structure used which, operating in a different direction compared with traditional methods, requires complex manufacturing operations.

A fly screen known as Genius was recently put on the market, which was designed to overcome the aforementioned problems. It is particularly used for horizontal fly screens, with the movement of the rewind roll imposed by manual traction of a closed-loop chain. This type of fly screen structure, used for doors with a large inter-axis, is made up basically of:

- a casing containing a rewind roll which is pre-charged by means of at least one torsion spring;
- a screen fastened at one end to the rewind roll, with a handle at the other end;
- runners in which the ends of the handle slide;
- and, a handle, the ends of which have holding means on the lower side that fit inside the runners.

The user, when unwinding the screen, pulls the closed-loop chain in one direction to carry out the lowering of the screen, until its respective handle reaches the limit at the base of the opening in question. When this position has been reached, in order to fasten the handle and, therefore, the screen in a stretched position, the user carries out a further pull so that the handle, made out of a rectangular tubular profile, rotates and inclines slightly on one side. In this position, pieces that protrude from the two ends of the handle intercept dedicated seats formed on the lower side of the runners, forcing the pieces to take up a certain position. At this point, the user releases the closed-loop chain so that the screen, which is under tension, pulls the handle upwards to force it from a slightly inclined position into a vertical position, forcing the pieces into corresponding recesses with stop points.

In order to release the handle and rewind the screen, the structure has a type of pedal along the handle. The purpose of this pedal, which is located in a central position, is to co-operate with the action applied to the closed-loop chain when it is pushed by the user. In particular, the user has to apply a slight pull downward on the chain with one hand in order to move the screen, while pressing the pedal with a foot. The pressure applied in this way on the pedal obliges the handle to rotate on one side, releasing it from its holding point and, since it is now free, may be rewound due to elastic pull.

The drawbacks regard the complicated manoeuvre that the user has to carry out to release the handle so that the screen can be rewound, especially with fittings with a large inter-axis, for example the type with a double batten.

This manoeuvre requires co-ordination and simultaneous use of a hand and a foot, which not everybody is able to do. The manoeuvre requires the lifting of a leg, which is only possible if the person is not disabled and the distance is short. When the fitting is larger, on the other hand, the user has to almost be a contortionist, and it is certainly not possible for everybody to carry out this kind of manoeuvre, since it is difficult to reach the pedal with a foot, located at the centre of the handle.

The difficulty is increased if we consider that the manoeuvre has to be perfectly synchronised, and if it is not carried out correctly it is impossible to release the screen.

Secondly, and certainly not to be overlooked, regards the appearance of the system. With the system described above, in order to release the screen efficiently, there has to be a pedal, which is visible and may be an obstacle.

In view of the drawbacks mentioned above, alternative solutions are obviously required and the aim of the invention described herein is to overcome the aforementioned drawbacks.

BRIEF SUMMARY OF THE INVENTION

This and other aims are achieved through the use of this invention according to the characteristics in the attached claims, solving the problems described by means of a mechanism for quick the hooking and unhooking of a handle, used particularly for fly screens and fly screen assemblies with a chain-operated movement, and that includes:

- a casing containing a rewind roll that is pre-charged by means of at least one torsion spring;
- a screen fastened at one end to the rewind roll, with a handle at the other end;
- runners, in which the ends of the handle slide;
- a handle with a tubular profile, with a hooking means on at least one end that operates in conjunction with a reciprocal holding means, located at the lower end of the corresponding runner. In the said holding means there is a block, which is fastened to the lower end of one of the runners. The said block is open on one side and has two surfaces that face each other that act as a guide with an entrance, an exit and an intermediate rest position. The said guide is hooked by a hooking means located at the end of the handle, and includes a guide piece, which longitudinally guides a mobile carriage. The said carriage has a protruding pin on at least one side that fits into at least one of the two guide-tracks in the block.

In this way, through the creative contribution of the system, which leads to an immediate technical progress, various advantages are achieved.

The first and, without a doubt, the most important advantage is that the hooking and releasing operations of the handle, while keeping the screen tight, are easier and more efficient. In order to unwind the screen, the user has to simply operate with the chain as with traditional systems to lower the handle down in the fitting in question, until a light resistance is felt. Upon continuing the operation, a mechanical "click" is heard which means that the handle is now in place and the protective effect desired is guaranteed.

To rewind the screen, the user has to simply apply a further, light pull on the chain so as to unhook the handle, and control the movement of the chain during the rewinding of the screen, which is caused by the rewind spring that was put into tension during the lowering operation of the screen. No other part of the body is required, therefore, apart from the hands, an operation that is simple and that can be carried out by anybody, including old and most disabled people.

A second advantage is that the said mechanism is extremely efficient for all types of fly screens and rewind screens in general, whatever the size of the fitting to be fitted out. This leads to a rationalisation of components kept in stock by the manufacturers and suppliers, leading to a reduction in overall costs.

A further advantage is that the pieces that protrude from the handle are eliminated which, apart from increasing the cost of the component, meant that it was anti-aesthetic and formed an obstacle.

These and other advantages will be shown in the following detailed description and drawings of at least one preferred application of the system, which is to be considered merely an illustration and not a limitation.

DETAILED DESCRIPTION OF THE INVENTION

Figure 1:
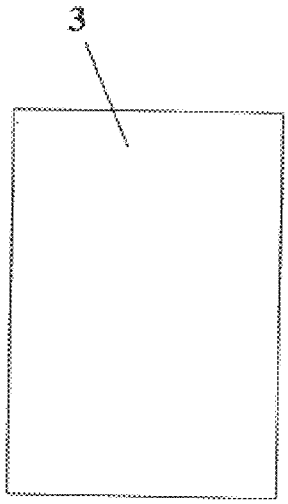
FIG. 1 is a side view of a block fixed to the lower end of at least one of the runners that guide the handle, in this case for a vertical fly screen assembly.
Figure 2:
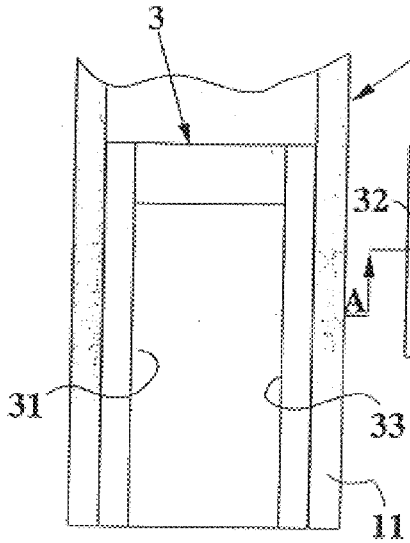
FIG. 2 is a front plan view of the block illustrated in FIG. 1, fitted into the lower end of a runner.
Figure 3:
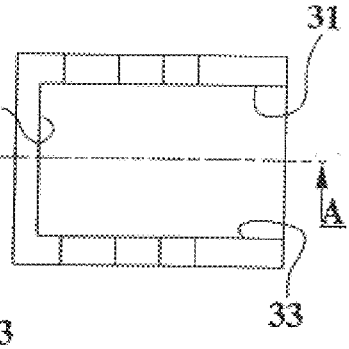
FIG. 3 is a plan view of the block illustrated in FIG. 1.
Figure 4:
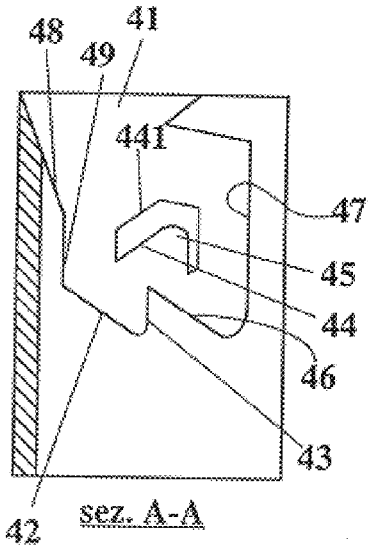
FIG. 4 is a vertical sectional view along axis A—A in FIG. 3 of the same block illustrated in the previous figures.
Figure 5:
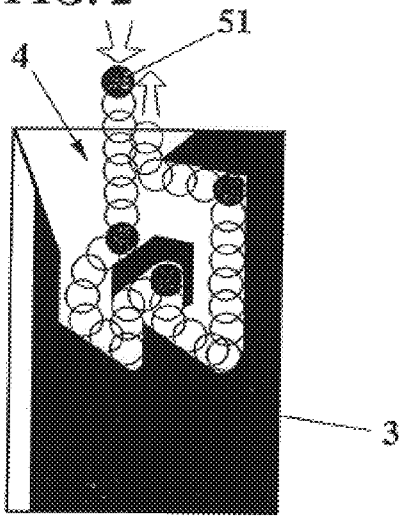
FIG. 5 is a sectional view of the same block with one of its sides removed, in order to illustrate the sequence of movements of the carriage inside the guide-track.
Figure 14:
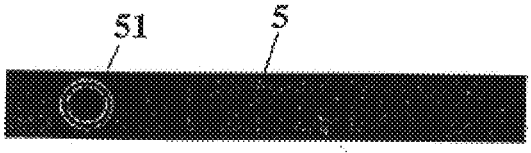
FIGS. 14 and 15 are, respectively, views of the side and the head of the carriage.
Figure 15:
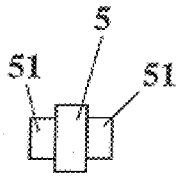
Figure 6:
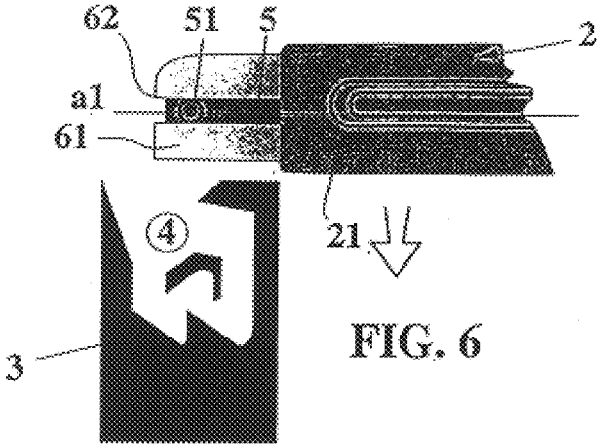
FIG. 6 is a side view of the phase before the carriage/runner assembly joined to the handle enters one of the counter-facing guide-tracks inside the guide block illustrated in FIG. 1.
Figure 7:
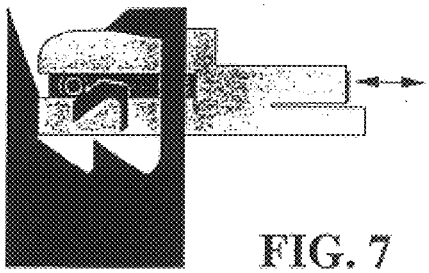
FIG. 7 is a side view of the phase that follows the phase shown in FIG. 6, showing the carriage coming into contact with the surface that acts as a guide.
Figure 8:
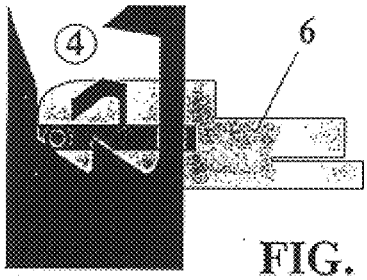
FIGS. 8 to 10 are schematic views of successive phases of the movement of the carriage inside one of the guide-tracks along the two sides of the said block.

By referring to the illustrations, a vertical fly screen includes at least one runner (1 ) that acts as a guide fastened along each vertical side of the fitting to be equipped, and a casing, made up of extruded aluminium for example, positioned at the upper part, that contains the fly screen, roller blind or sun blind. Inside the said casing, there is a rewind roll. The said fly screen, roller blind or sun blind rewind roll has a rewinding mechanism which includes a torsion spring that, if rotated in one direction, and being held in position at one end, is stretched to allow the rewind roll to return to its position. The said mechanism also has, on at least one side, a closed-loop chain which moves a rotating component inside the casing and that is fastened to the rewind roll.

Going further into detail, one end of the fly screen, roller blind or sun blind is fixed to the rewind roll, while the opposite end has a handle (2), which has its ends inside the guide runners (1).

Each guide runner (I), in this case, has a block (3) at its lower end made up of a monolithic body in low-friction plastic. The said block (3) is made up of three sides (31, 32, 33) at 90° to each other to form a "C", shape. One of the three sides (32) makes up the back part and rests against the inside back of the guide runner (1). The other two (31, 33) make up the sides of the block (3) and rest on the inner sides of the guide runner (1). Each side (31) and (33) of the block (3) also has a guide track (4) on the surface that faces the opposite mirror image surface (31) and (33) of the block (3).

The said guide track (4), in this case, is formed by removing material from the thickness of the side in question, in this case both (31, 33), in order to form a central zone around which the stepped-type guide track (4) is formed. Going further into detail, the path is as follows:

an entrance and exit (41) in common;

a first part is carried out diagonally (42) up to the vertical stop (43);

in correspondence with the vertical stop (43) there is another diagonal portion above (44) that runs in the opposite direction to the first diagonal portion (42) up to the stop position (45);

a stop (45) defined by a portion that is perpendicular to a lower diagonal portion (46) that leads to the stop with a straight, vertical portion (47) to lead to the entrance/exit part (41) of the path (4).

The purpose of the said track (4) is to guide a longitudinally mobile carriage (5) that is part of the handle (2) during its perpendicular movement. Going further into detail, inserted into each end (21) of the tubular handle, there is a monolithic guide piece (6) that protrudes on one side (61) and slides along the inside of the runner (1). Each guide piece (6) has a seat, which permits the carriage (5) to slide longitudinally. In this case, the protruding side (61) of the guide piece (6) has a slit (62) on both sides along which the protruding part (51) of the carriage (5) passes and slides, according to axis (a ). Going further into detail, the extremity of the carriage (5) has two symmetrical counter-facing protrusions (51) which stick out from the sides of the guide piece (6). In this way, each protrusion (51), in this case made up of a cylindrical piece that sticks out perpendicularly from the sides of the carriage (51), follow a given path (4) formed on the inside of the corresponding sides (31) and (33).

Figure 9:
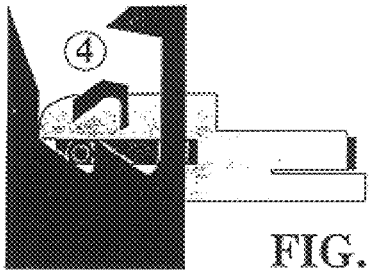
Figure 10:
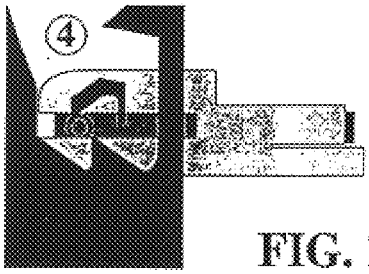
Figure 11:
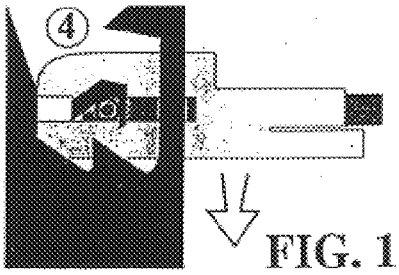
FIG. 11 is a side view of the carriage/support mechanism in the home position, which corresponds with the blocking of the lowered fly screen handle.
Figure 12:
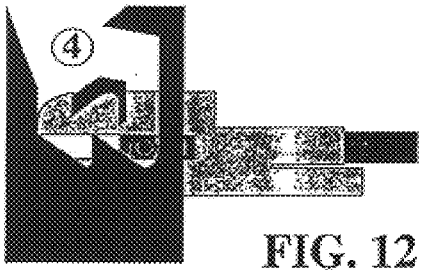
FIG. 12 shows a schematic view of successive phase after further lowering the fly screen and the handle, and that proceeds the partial release of the carriage from the guide inside the block.
Figure 13:
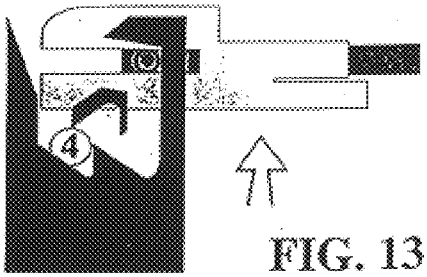
FIG. 13 shows a schematic view of phase that follows the phase illustrated in FIG. 12, and corresponds to the fly screen and handle going upwards and its complete release of the carriage from the guide inside the block.

When operating the system, the user pulls down on a chain to lower the fly screen. The said chain rotates a rewind roll that is slightly pre-loaded by means of a spring. The rewind roll rotates and lets the fly screen, with its relative weighted handle (2), lower down due to the force of gravity. The said handle (2) is positioned inside the runners (1) by means of the protruding parts (61) of the guide piece (6), in order to operate the relative carriage (5) along the runner (1). When it gets close to the bottom, the handle (2) allows the user to feel a slight impediment, given by the protruding parts (51) of the carriage (5) interfering with one of the surfaces of the path (4). The said surfaces, for example if the protruding parts (51) of the carriage (5) are not in line, may be either the diagonal part (441) of the central zone, located immediately below the entrance (41), or the diagonal part (48) that is before the straight part (49) that leads towards lower diagonal part (43) which is part of the "stepped" guide track (4). If the protrusions (51) of the carriage (5) are in line on the other hand, they intercept the lower diagonal part (42). When the said impediment is felt, the user carries out a further pull towards the bottom, which determines a further movement of the carriage (5) in order to follow the guide track (4) until it reaches the position illustrated in FIG. 9. This position corresponds with the lower limit and at this point the user may release the chain. Since the net of the fly screen is forced to return upwards due to the pull of the return spring on the rewind roll, the handle (2) is also forced to return upwards, leading the protrusions (51) by means of the inclined surface (44) that lies above the stop point (43) into the seat (45) as shown in FIG. 11. When it is in this position, the handle (2) stays in a hooked position, with the net of the fly screen pulled tight.

In order to release the handle (2), the user has to pull the chain down which causes the handle (2) and, therefore, the guide piece (6) and relative carriage (5) to be lowered, until it reaches the lower diagonal part (46). In this position, the carriage (5) moves back in order to unhook from the hooking piece, so that when the chain is slowly released it causes the assembly to rise up along the vertical portion (47) until the protruding parts (51) of the carriage (5) come out from the entrance/exit (41) on the exit side.

We claim:

1. A mechanism for hooking and releasing a blind or a screen comprising:

a handle having a hooking element extending therefrom from each end of said handle; and a guide runner having at least one guide track, the guide track being cooperative with said hooking element of said handle, the guide track having an entrance opening and an exit opening and an intermediate rest section, said hooking element having a longitudinally movable carriage with a pin protruding transversely outwardly from at least one side thereof, said pin being cooperative with surfaces within the guide track so as to be releasably retained by said intermediate rest section within the guide track, the guide track having a first side in parallel relation to a second side and a back side extending therebetween, the entrance and exit opening and intermediate rest section being formed on an inner surface of each of said first and second sides.

2.The mechanism of claim 1, said guide runner having a block fitted to an end thereof, said block having said first and second sides and said back side formed therein.

3. The mechanism of claim 2, said first side being at a 90° angle with respect to said back side, said second side being at a 90° angle to said back side, said first and second sides resting on inner sides of said guide runner.

4. The mechanism of claim 1, said guide track being formed in a thickness of each of the respective first and second sides.

5. The mechanism of claim 1, said guide track having a first section extending diagonally toward a vertical stop, said intermediate rest section having a diagonal portion above said first section extending in an opposite diagonal orientation thereto, said diagonal portion extending to a stop member, said stop member defined by a portion that is perpendicular to a second section therebelow, said second section extending diagonally downwardly from a side of said vertical stop, said second section extending to a straight vertical surface, said straight vertical surface directed toward said entrance opening.

6. The mechanism of claim 5, said diagonal portion of said intermediate rest portion being directly above and spaced from said vertical stop.

7. The mechanism of claim 1, said handle having a guide piece inserted into at end thereof so as to protrude outwardly therefrom, said guide piece being slidable interior of said guide runner.

8. The mechanism of claim 7, said guide piece having a slot therein, said carriage slidable longitudinally in said guide piece, said guide piece having a slot along which said pin slides.

9. The mechanism of claim 8, said pin comprising a first pin and a second pin protruding outwardly from opposite sides of said carriage, said first pin being symmetrical to said second pin, each of said first and second pins having a cylindrical configuration engaging the respective guide track.

10. A fly screen assembly comprising:

a casing having a rewind roll therein charged by at least one tension spring;

a screen fastened at one end of said rewind roll, said screen having a handle at an opposite end thereof;

a pair of runners respectively on opposite sides of said screen, said handle slidable within said pair of runners, said handle having a tubular shape with a hooking element on at least one end thereof;

a holding means positioned below the runner for retaining the hooking element therein, said holding means comprising a block fastened to a lower end of the runner, said block being open on one side and having a pair of surfaces facing each other, said block having an entrance and an exit and an intermediate rest section, said hooking element comprising a guide piece which receives a mobile carriage slidable longitudinally therein, said carriage having a protruding pin extending transversely outwardly from one side thereof, said protruding pin fitting into a guide track formed on said pair of surfaces of said block.

11. The assembly of claim 10, further comprising:

a chain means connected to said rewind roll for unwinding said screen from said casing.

* * * * *